United States Patent [19]

Crankshaw et al.

[11] 4,267,925

[45] May 19, 1981

[54] CLOSURE FOR LARGE-VOLUME VIAL

[75] Inventors: Gary K. Crankshaw, Kalamazoo, Mich.; Roger A. Erber, Mount Prospect, Ill.

[73] Assignee: The Upjohn Company, Kalamazoo, Mich.

[21] Appl. No.: 80,740

[22] Filed: Oct. 1, 1979

[51] Int. Cl.[3] ..... B65D 25/08

[52] U.S. Cl. ..... 206/221; 215/DIG. 8

[58] Field of Search ..... 206/219, 221; 215/DIG. 8

[56] References Cited

U.S. PATENT DOCUMENTS

| | | | |
|---|---|---|---|
| 3,464,414 | 9/1969 | Sponnoble | 215/DIG. 8 |
| 3,489,306 | 1/1970 | Bubb | 206/221 |
| 4,024,952 | 8/1977 | Leitz | 215/DIG. 8 |
| 4,102,451 | 7/1978 | Clarke et al. | 215/DIG. 8 |

*Primary Examiner*—Joseph Man-Fu Moy

*Attorney, Agent, or Firm*—Blanchard, Flynn, Thiel, Boutell & Tanis

[57] ABSTRACT

A vial structure wherein the neck of a two-compartment vial has a resilient stopper sealingly seated therein. The stopper has an upper projecting portion of smaller diameter, with the upper and lower portions being joined by an intermediate portion which defines a surrounding annular groove. A cap member surrounds the projecting portion of the stopper and is attached to the vial rim. The cap includes concentric inner and outer sleevelike skirts joined together by a top wall. The inner skirt snugly surrounds the upper stopper portion and terminates in a lower locking flange which projects into the annular groove to prevent the cap from being axially removed from the stopper. This inner skirt can be axially slidably inserted into the neck. The outer skirt is axially longer than the inner skirt and, at the lower end thereof, has a locking flange which resiliently snaps beneath the vial rim to lock the cap thereto. The outer skirt also has a second locking flange at a location spaced upwardly from the lower end so that, upon activation, the cap is pushed downwardly until the second locking flange snaps into position below the rim.

10 Claims, 5 Drawing Figures

CLOSURE FOR LARGE-VOLUME VIAL

FIELD OF THE INVENTION

This invention relates to an improved vial structure and, more specifically, to a two-compartment vial having a closure structure associated with the open end thereof which effectively prevents accidental contamination of the contents of the vial while facilitating activation of the vial to permit mixing of the contents.

BACKGROUND OF THE INVENTION

Two-compartment vials in which a lyophilized medication and a solvent are held in complete independence from each other, have been in common use for packaging and mixing medications for many years. However, such use has been frequently marked by problems, some of which have related to the closure structure for the vial. In order to dislodge the center plug from between the compartments so that the solvent can be mixed with the medication, it is necessary to depress the stopper which is partially disposed in the neck of the vial and projects somewhat beyond the neck. However, the projecting portion of the stopper tends to bulge radially outwardly when depressed and therefore opposes insertion into the neck. Further, the harder the stopper is pushed into the vial, the more aggravated the problem becomes. On the other hand, if the stopper is made from less flexible or resilient material, in order to minimize bulging, then leakage of the solvent past the stopper readily occurs.

In an attempt to minimize or prevent bulging of the projecting stopper portion, U.S. Pat. No. 4,089,432 discloses a cap or closure structure wherein the projecting stopper portion is closely surrounded by a cylindrical sleeve which is attached to a vial mounting ferrule by means of a frangible connection. This connection must be broken in order to urge the sleeve and the stopper into the neck of the vial so as to displace the center plug. While the cap structure of this patent has proven to operate in a highly desirable manner, nevertheless in some instances it is undesirable to provide a cap having a frangible connection associated therewith.

The cap structure for the vial must be capable of closing and sealing the vial to prevent contamination of the medication therein. The cap structure must also be easily attached to the vial and must be capable of efficient and dependable activation when use of the medication is desired, which activation must be capable of accomplishment without causing contamination of the medication or of the syringe used for withdrawing it.

Accordingly, it is an object of the present invention to provide an improved closure structure specifically for a two-compartment vial. The closure structure involves a cap which surrounds and permits activation of the stopper sealingly seated within the neck of the vial, whereby activation of the stopper is more uniformly achieved while at the same time the stopper and the vial contents are maintained free of contamination. The cap additionally has locking structures associated therewith such that it is fixedly connected to the vial when in a non-activated condition, and is also similarly locked to the vial when in an activated position to permit secure handling of the vial, such as during insertion of a syringe through the stopper, without requiring removal of the cap.

In the vial and closure assembly of the present invention, the open or neck end of the vial has a resilient stopper sealingly seated therein, which stopper has a lower cylindrical portion of larger diameter seated within the neck. The stopper also has an upper projecting portion of smaller diameter, with the upper and lower portions being joined by an intermediate portion which defines a surrounding annular groove. A one-piece cap member surrounds the projecting portion of the stopper and is attached to the rim of the vial. The cap includes concentric inner and outer sleevelike skirts which are radially spaced apart and are joined together by a top wall. The inner skirt snugly surrounds the upper stopper portion and terminates in a lower locking flange which projects into the annular groove to prevent the cap from being axially removed from the stopper. This inner skirt is of slightly smaller diameter than the inner diameter of the neck so that activation of the vial causes the stopper and inner skirt to be axially slidably inserted into the neck. The outer skirt is axially longer than the inner skirt and, at the lower end thereof, has an inner locking flange which resiliently snaps beneath the annular rim of the vial to lock the cap thereto. The outer skirt also has a second locking flange on the inner surface thereof at a location spaced upwardly from the lower edge so that, upon activation, the cap is pushed downwardly so that the vial rim moves past the second locking flange, as permitted by limited resilient deformation of the cap, and snaps into position below the rim to positively lock the depressed cap to the vial.

Figure 1:
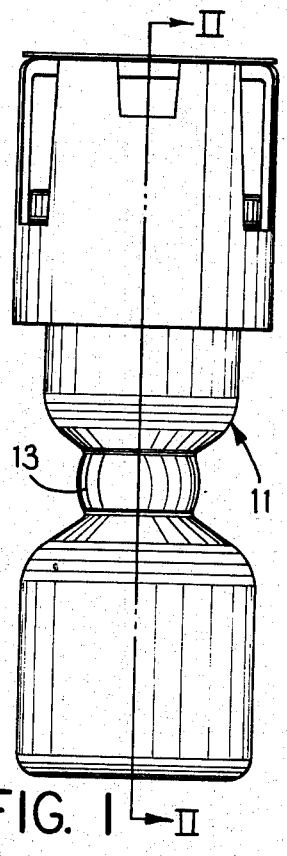
FIG. 1 is a side elevational view of a vial and closure assembly embodying the invention.

For convenience in description, the terms "upper", "lower" and words of similar import will have reference to the invention and parts thereof as appearing in FIG. 1. The terms "inner", "outer" and derivatives thereof will have reference to the geometric center of the vial and parts thereof.

DETAILED DESCRIPTION

The vial assembly 10 (FIGS. 1 and 2) includes a two-compartment vial or container 11 which is closed at the lower end thereof, and is open at the upper end to permit filling thereof. A closure structure 12 sealingly closes the open end of the vial to prevent contamination of the contents thereof. The closure structure, after attachment thereof to the vial, is substantially permanently connected thereto since removal of the closure structure is likely to result in destruction thereof.

The vial 11 has a constriction 13 intermediate the ends thereof, and a moisture barrier or plug 14 is sealingly seated within this constriction. This plug 14, which is inserted during the filling of the vial, sealingly divides the vial into two compartments 16 and 17. In a typical utilization of the vial assembly 10, a lyophilized medication is placed in the lower compartment 16, and a preselected quantity of a liquid solvent is stored within the upper compartment 17.

The upper end 18 (FIG. 2) of the vial defines an open neck portion, the free end of which terminates in a radially outwardly extending annular flange or rim 19.

Figure 4:
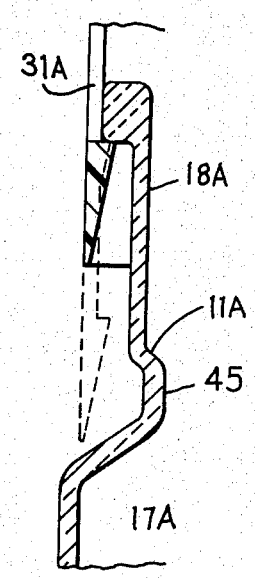
FIG. 4 is a modified fragment of FIG. 2.
Figure 5:
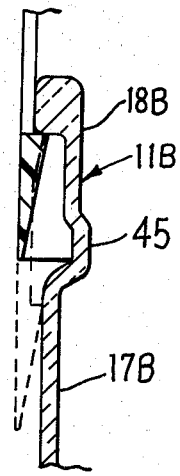
FIG. 5 is a further modified fragment of FIG. 2.

This neck portion 18 defines an opening 21 which is in direct communication with the upper compartment 17 and permits initial filling of the vial. In the present invention, the sidewall of the vial defining the upper compartment 17 and the open neck portion 18 are preferably of identical inner diameters so as to define a continuous and uniform inner wall. This facilitates the manufacture of the vial from tubular glass stock and, additionally, permits the vial to be made in a larger size so as to handle larger dosages of medication. However, the vial may be as shown in FIGS. 4 and 5.

The neck opening 21 is sealingly closed by the closure structure 12 which includes a substantially cylindrical stopper 22 preferably fabricated from a resiliently flexible material impervious to the solvent contained in the upper compartment 17. The stopper has a deep, downwardly opening recess 23 communicating with the upper compartment so that a needle of a conventional syringe can be inserted axially through the upper end of the stopper with relative ease.

The stopper 22 has a lower cylindrical portion 24 which is sealingly disposed within the neck of the vial. This lower stopper portion 24, when in a relaxed or uncompressed condition, has an outer diameter which is slightly greater than the diameter of the vial opening 21 so as to cause slight compression of the stopper portion 24 to insure a proper sealing and seating of the stopper within the vial neck. The lower stopper portion 24 can, if desired, be provided with a plurality of spaced, angular ridges therearound so as to provide a different type of sealing engagement between the stopper and the vial.

Stopper 22 also includes an upper cylindrical portion 26 which is coaxially aligned with the lower portion 24 and protrudes outwardly beyond the vial. This upper portion 26 is of smaller diameter than the lower portion 24, and is integrally joined thereto by an intermediate stopper portion 27. This latter portion 27 is of smaller diameter and thus defines an external annular groove 28 in surrounding relationship to the stopper, which groove is normally positioned adjacent but just outwardly from the free end of the vial neck 18 when the stopper is sealingly seated therein. This groove 28 provides an upper shoulder 29 at the junction with the upper stopper portion 26 and a lower shoulder 30 adjacent the lower stopper portion 24.

The closure structure 12 also includes a cap member 31 which surrounds the stopper 22 and is mechanically interlocked to the neck portion of the vial. This cap member 31 is normally constructed in one piece, such as by molding, of a plastic material, such as polyethylene, so that the cap member will have limited resilience and flexibility, but at the same time will still be relatively rigid.

The cap 31 includes an inner sleevelike skirt 32 which closely and snugly surrounds the upper stopper portion 26 to prevent any undesired outward bulging or sideward deflection of the upper portion during pressing thereof into the vial. The inner skirt 32 which extends the full axial length of the upper portion 26 and intermediate portion 27, has at its lower end an annular locking flange 33 which extends radially inwardly into the groove 28 and thereby mechanically interlocks the cap member and the stopper. The inner surface of the locking flange 33 diverges downwardly to facilitate the initial axial insertion of the stopper portion 26 into the skirt 32. This insertion is accomplished by the permissible resilient deformation of both the stopper portion 24 and the lower end of the skirt 32.

The skirt 32 has an outer diameter which is preferably slightly smaller than the diameter of the vial opening 21 so that skirt 32 and stopper portion 26 can axially move as a unit directly into the vial neck 18.

The cap 31 also includes an outer cylindrical skirt 36 which is concentric with but spaced radially outwardly from the inner skirt 32. The sleeve 32 and skirt 36 are integrally joined together by an annular top wall 37. The outer skirt 36 is of greater axial length than the inner sleeve 32, and is preferably, axially slightly longer than the stopper 22.

The skirt 36 has spaced locking flanges arranged in a circle at the lower end thereof and extending radially inwardly thereof so as to project under the annular rim 19, thereby mechanically locking the cap member beneath the rim 19 and against accidental separation between the cap member and the vial. The locking flanges 38 have downwardly diverging surfaces 39 which, during mounting of the cap member on the vial, facilitate movement of the flanges 38 over the vial rim 19.

Slots 40 are provided in the sidewall of the skirt 36 when the flanges 38 are formed, and these slots augment the resilient deformation of the skirt 36 whereby the flanges 38 can slide downwardly past the rim, following which the flanges 38 resiliently snap beneath the rim to lock the cap on the vial. The inner diameter of the skirt 36 above the locking flanges 38, is preferably slightly greater than the outer diameter of the annular rim 19 so that the outer skirt 36 can move axially, relatively freely with respect to the vial 11 from its nonactivated position of FIG. 2 up to its activated position of FIG. 3.

A locking flange 41 is integrally connected to the inner surface of the outer skirt 36 and projects radially inwardly therefrom. Locking flange 41 which is spaced upwardly a substantial distance from the lower flanges 38, is preferably spaced axially downwardly from the top wall 37 a distance approximately equal to the axial thickness of the vial rim 19. This locking flange 41 terminates in a shoulder 42 at the upper end thereof, which is engageable with the lower surface of the rim 19, when the cap 31 is in its activated position, to firmly hold said cap 31 in its activated position. Said flange 41 is provided with a downwardly diverging inner surface 43 which facilitates movement of the flange 41 past the vial rim 19 when the closure structure is moved into the activated position illustrated in FIG. 3. As the cap 31 approaches the activated position of FIG. 3, the locking flange 41 is resiliently distorted so that it can move over the rim 19 into a position below the vial rim 19, thereby positively holding the rim 19 adjacent the top wall 37 of the cap.

While the locking flange 41 is disclosed as extending continuously around the inner periphery of the outer skirt 36, it can be replaced by a plurality of angularly spaced projections of similar cross-sectional configuration. Also, the flanges 38 can be extended circumferentially of the skirt 36 to form an annulus.

The opening in the top of the cap member 31 is closed by a dust shield 44 which is sealingly but removably secured thereto, whereby the stopper 22 is substantially totally enclosed by the dust shield 44 and the cap member 31. Thus, particularly the upper surface of the stopper, which is to be penetrated by the syringe needle, can be maintained in a clean and uncontaminated condition.

OPERATION

The lower chamber 16 is filled with a lyophilized or liquid medication, for example, the center plug 14 is then sealingly seated within the constriction 13, and a liquid solvent or diluent is placed in the upper chamber 17, all in a well-known manner. Thereafter, the lower stopper portion 24 is inserted into the opening 21 to sealingly close the vial. When so seated, the upper stopper portion 26 projects outwardly of the vial.

The cap member 31 is then placed on the stopper and on the vial, this being accomplished by forcing the inner sleeve 32 downwardly over the upper stopper portion 26. As flange 33 on sleeve 32 approaches the groove 28, the lower end of outer skirt 36 contacts the vial rim 19 and is resiliently deformed outwardly so that the lower locking flanges 38 can axially pass thereover.

When the cap 31 reaches its inactivated position, as shown in FIG. 1, the lower locking flanges 38 on the outer skirt are located beneath the vial rim 19 to thereby mechanically lock the cap member to the vial. Substantially simultaneously, the lower locking flange 34 on inner sleeve 32 becomes located beneath the shoulder 29 to thereby mechanically interlock the cap 31 to the stopper 22. With this interlock arrangement, the cap member cannot be axially removed from the vial, and similarly the stopper 22 cannot be pushed downwardly into the vial independently of the cap.

After assembly of the stopper and cap as described above, the shield 44 is then sealed upon the top wall 37 of the cap to close off the upper end of the stopper.

Figure 2:
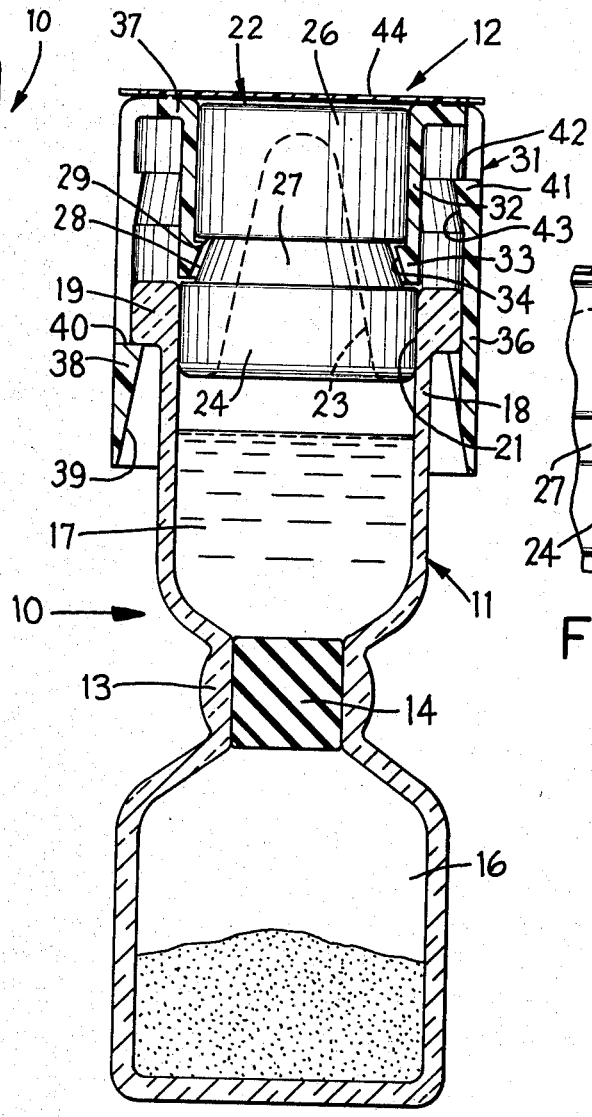
FIG. 2 is a central sectional view taken along the line II—II in FIG. 1.

With the closure structure assembled as illustrated in FIGS. 1 and 2, the contents of the vial are maintained in a sealed and uncontaminated condition to permit safe storage and handling thereof. The closure structure, including either or both of the cap 31 and stopper 22, cannot be accidentally or even intentionally removed from the vial without applying extreme force or fracturing the vial so that accidental contamination of the vial is positively prevented.

When it becomes desirable to use the medication, the two ends of vial 11 can be engaged by and between the palms which are then urged together. Alternatively, the closure structure can be pressed endwise against a fixed surface, whereby the closure structure 12 is moved toward the vial. The stopper 22 and cap 31 are simultaneously moved toward and into the vial in telescoping relationship therewith. Such movement of the stopper 22 creates hydraulic pressure within the upper compartment 17 which forces the plug 14 out of the constriction 13 so that the solvent can move into the lower compartment 16 and mix with the medication therein. During the inward movement of the cap 31 toward the vial neck, the upper stopper portion 26 and the surrounding inner sleeve 32 move axially into the vial neck until the stopper reaches the activated position illustrated in FIG. 3.

Specifically, the endwise pressure applied to the vial assembly causes the skirt 36 to slide axially over the vial rim 19 until the upper locking flange 41 engages and then slidably moves downwardly past the vial rim 19. This is permitted by the resilient deformation of the cap member, following which the annular locking flange 41 resiliently snaps into a locking position beneath the vial rim 19. The complete closure structure is thus locked into the vial in the activated position illustrated in FIG. 3. When so positioned, the shield 44 is removed and a syringe needle is used to penetrate the upper end of the stopper 22 to thereby permit removal of the medication. After the medication has been totally utilized or used to the extent desired, the complete vial assembly is then disposed of inasmuch as the closure structure remains locked to the vial, thereby preventing reuse of either the vial or the closure structure.

Figure 3:
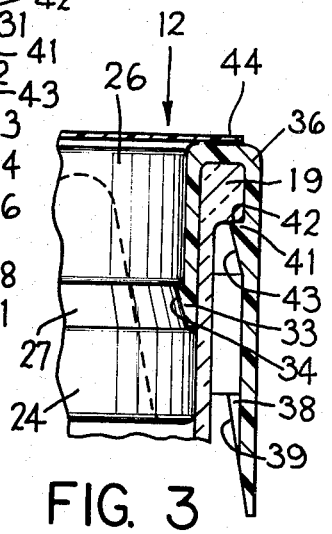
FIG. 3 is a fragmentary sectional view showing the closure structure in an activated position.

Inasmuch as the neck portion 18 and the vial sidewall defining the compartment 17 are of a continuous and uniform inner diameter, the lower stopper portion 24 remains in snug sealing engagement with the inner sidewall of the vial even when in the activated position of FIG. 3, so that contamination of the medication within the vial is still prevented. This thus enables the improved vial assembly of this invention to be utilized in those situations where slow removal of the medication from the vial is desired. For example, the improved vial assembly 10 can be connected to an intravenous tube so as to permit the slow, intravenous supply of medication to a patient. In such a use situation, the intravenous tube can be connected to a second tube having a spike or needle on the end thereof for piercing the stopper 22, the other end of this second tube being provided with a needle for communication with the intravenous tube. The vial assembly of the present invention is capable of use in this manner due to the rigid and sealed interconnection of the complete closure structure to the vial, even after activation thereof.

FIGS. 4 and 5 illustrate fragments of the upper ends of vials 11A and 11B, respectively, wherein the inside diameters of the upper compartments 17A and 17B are somewhat larger than the inside diameters of the neck portions 18A and 18B. Thus, constrictions 45 are provided at the lower ends of the neck portions to prevent movement of the stopper 22 into the upper compartments.

Where the upper compartment 17A is substantially larger than the neck portion 18A, said neck portion must be elongated so that the upper end wall of the upper compartment 17A will not obstruct movement of the cap 31A into its activated position, shown in broken lines.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In combination, a two-compartment mixing vial having a constriction between the two compartments, a removable plug disposed within the constriction to provide a liquid-tight barrier between the two compartments, said vial having a neck at one end thereof for defining an opening communicating with one of said compartments, said neck having an annular radially outwardly projecting rim adjacent the free end thereof, and a closure structure attached to said neck for closing the opening therein, said closure structure including a substantially cylindrical and resiliently flexible stopper means including a first portion having an outside diameter which is normally slightly larger than the inside diameter of, and sealingly received within, said neck, said stopper means including a second portion of reduced diameter projecting beyond the free end of said neck, said closure structure also including cap means having a top wall and a cylindrical skirt fixed to said top wall and projecting therefrom in surrounding relationship to said stopper, said skirt having radially inwardly projecting flange means adjacent the free end thereof, said skirt being telescoped over said annular rim with said flange means located below said rim to mechanically lock said cap means upon said vial, the improvement comprising:

means defining a surrounding annular groove in said stopper means intermediate said first and second portions thereof, said annular groove being disposed adjacent to and outwardly of said rim, said groove having spaced side walls;

said cap means including an inner sleeve affixed to said top wall, concentric with said outer skirt and spaced inwardly therefrom, said inner sleeve surrounding said second stopper portion and having an outside diameter no greater than the inside diameter of the vial neck opening so that said inner sleeve can be moved axially into said neck along with the second stopper portion upon the urging of said closure structure toward said vial, said inner sleeve having radially inwardly projecting locking means extending into said annular groove for axially mechanically interlocking said cap to said stopper whereby axial movement of said cap means causes corresponding axial movement of said stopper means.

2. A combination according to claim 1, wherein said outer skirt has second locking means projecting radially inwardly thereof near said top wall, said second locking means being spaced substantially from said flange means and from the top wall for reception of said vial rim between said second locking means and said top wall when said vial and closure structure are in the activated condition.

3. A combination according to claim 2, wherein said inner sleeve has an axial length substantially less than that of said outer skirt, and said first-mentioned locking means is integrally formed on said inner sleeve adjacent the free end thereof.

4. A combination according to claim 3, wherein said top wall of said cap member is of an annular configuration and extends radially between said inner sleeve and outer skirt, said top wall being disposed substantially flush with the upper surface of the second stopper portion, and removable shield means extending across the upper end of said stopper means and being sealingly attached to said top wall.

5. A combination according to claim 3, wherein the inside diameters of said neck and said one compartment are of the same diameter, whereby the first portion of the stopper means remains in sealed engagement with said wall of the vial even when the closure structure is locked in the activated position.

6. In combination, a two-compartment mixing vial having a constriction between the two compartments capable of receiving a removable plug which provides a liquid-tight barrier between the two compartments, said vial having a neck portion at one end thereof which defines an opening for communication with one of said compartments, the opening defined by said neck portion and said one compartment being of continuous and uniform internal diameter throughout the length thereof, said neck portion also having a radially outwardly projecting annular rim adjacent the free end thereof, and a closure structure for attachment to said vial for sealingly closing said opening, said closure structure comprising:

a resiliently flexible, substantially cylindrical stopper having a first cylindrical portion with an outside diameter slightly larger than the inside diameter of said neck portion, said first stopper portion being snugly and sealingly received into said neck portion for sealingly closing said opening;

said stopper including a second substantially cylindrical portion which is integrally connected to said first stopper portion and projects axially outwardly beyond the free end of said neck portion, said second stopper portion being of smaller diameter than said first stopper portion;

groove means formed in the annular sidewall of said stopper adjacent the interface between said first and second stopper portions, said groove means projecting radially inwardly relative to the sidewall of said second stopper portion;

cap means disposed in surrounding relationship to said stopper and said annular rim and being axially mechanically interconnected to said neck portion and said stopper to prevent axial separation of said cap from said vial and to prevent axial depression of said stopper into said vial independently of said cap means;

said cap means comprising a one-piece annular cap constructed of a material which is relatively rigid but slightly resiliently flexible;

said cap including an end wall which is spaced outwardly a substantial distance from the vial rim and is disposed in the vicinity of the outer free end of said stopper, said cap also including concentric inner and outer skirt portions which are each of a substantially cylindrical configuration, said inner and outer skirt portions being radially spaced apart and each being attached at one end thereof to said end wall and projecting axially therefrom in the same direction toward said vial;

said inner skirt portion being closely and snugly disposed in surrounding relationship to said second stopper portion and having an outer diameter no greater than the diameter of said vial opening so that said inner skirt portion can slidably telescope into said neck portion along with said second stopper portion, said inner skirt portion also having radially inwardly projecting locking means thereon which project into said groove means to prevent axial depression of said second stopper portion into said vial independently of said cap; and said outer skirt portion projecting axially a sufficient extent so that the free end portion thereof surrounds and axially telescopes over the annular rim of said vial, said skirt portion having projecting means thereon and extending radially inwardly so as to radially overlap the lower surface of said annular rim to prevent axial separation of said cap from said vial.

7. A combination according to claim 6, wherein said outer skirt portion has second projection means formed integrally thereon and projecting radially inwardly thereof for lockingly connecting said cap to said vial when said closure structure is in an activated position, said second projecting means being located radially between said first-mentioned projection means and said end wall.

8. A combination according to claim 7, wherein said first-mentioned and second projection means each comprises an annular flange which is integral with said outer skirt portion and projects radially inwardly from the inner peripheral wall thereof, each of said annular flanges having an upper shoulder adapted to be positioned beneath the annular rim for locking the cap to said vial, each of said annular flanges also having a lower surface which is inclined downwardly and outwardly to facilitate camming of the flange over the vial rim during telescopic relative axial movement of the cap toward the vial.

9. A combination according to claim 8, wherein the groove means concentrically surrounds the stopper and defines a shoulder at the side thereof adjacent said second stopper portion, and said locking means comprises an annular flange which is integral with said inner skirt portion adjacent the free end thereof, said annular flange projecting radially inwardly of said inner skirt portion for projecting into said annular groove so as to radially overlap said shoulder.

10. In combination, a two-compartment mixing vial having a constriction between the two compartments, a removable plug disposed within the constriction to provide a liquid-tight barrier between the two compartments, said vial having a neck at one end thereof for defining an opening communicating with one of said compartments, said neck defining an annular radially outwardly projecting rim adjacent the free end thereof in surrounding relationship to said opening, and a closure structure attached to said neck for closing the opening therein, said closure structure including a substantially cylindrical stopper of a resiliently flexible material sealingly disposed within said neck, said stopper including a first substantially cylindrical portion having an outside diameter which is normally slightly larger than the inside diameter of said neck, said first cylindrical portion being snugly and sealingly received within said neck, said stopper including a second cylindrical portion of reduced diameter projecting outwardly beyond the free end of said neck, said closure structure also including a cap member having a top wall and an outer cylindrical skirt portion fixed to said top wall and projecting downwardly therefrom in surrounding relationship to said stopper, said outer skirt portion having an annular locking flange thereon which projects radially inwardly of said skirt portion, said outer skirt portion being axially movable over said annular rim of said vial with said annular locking flange resiliently snapping into position below said rim to mechanically lock said cap member to said vial to prevent axial separation therebetween, comprising the improvement wherein said stopper includes a surrounding annular groove located intermediate the ends thereof substantially between said first and second cylindrical portions, said annular groove being disposed adjacent but outwardly of said rim, said groove defining a shoulder at the side thereof adjacent said second stopper portion, said cap member including an inner substantially cylindrical skirt portion which is fixed to said top wall and projects axially therefrom in the same direction as said outer skirt portion, said inner skirt portion being concentric with and spaced inwardly of said outer skirt portion, said inner skirt portion being closely and snugly disposed in surrounding relationship to said second cylindrical stopper portion and having an outside diameter which is no greater than the diameter of the vial opening so that said inner skirt portion can be moved axially inwardly into the neck of said vial along with the second cylindrical stopper portion upon the urging of said closure structure toward said vial, said inner skirt portion having radially inwardly projecting locking means thereon which project into said annular groove and are disposed adjacent said shoulder to prevent axial depression of said stopper without causing a simultaneous axial depression of said cap member.

* * * * *